United States Patent [19]

Carlson et al.

[11] Patent Number: 5,075,021

[45] Date of Patent: Dec. 24, 1991

[54] OPTICALLY TRANSPARENT ELECTRORHEOLOGICAL FLUIDS

[76] Inventors: J. David Carlson, 429 Oakridge Rd.; Joseph E. Bares, 1605 Glengarry Dr., both of Cary, N.C. 27511

[21] Appl. No.: 414,821

[22] Filed: Sep. 29, 1989

[51] Int. Cl.[5] ..... C09K 3/00; C10M 125/00

[52] U.S. Cl. ..... 252/73; 252/78.3; 252/572

[58] Field of Search ..... 252/78.3, 73, 572

[56] References Cited

U.S. PATENT DOCUMENTS

| | | | |
|---|---|---|---|
| 3,047,507 | 7/1962 | Winslow | 252/75 |
| 3,367,872 | 2/1968 | Martinek et al. | 252/74 |
| 3,385,793 | 5/1968 | Klass et al. | 252/75 |
| 3,397,147 | 8/1968 | Martiner | 252/78.3 |
| 3,412,031 | 11/1968 | Martinek et al. | 252/75 |
| 4,645,614 | 2/1987 | Goossens et al. | 252/75 |
| 4,702,855 | 10/1987 | Goossens et al. | 252/75 |

*Primary Examiner*—Paul Lieberman
*Assistant Examiner*—Christine A. Skane

[57] ABSTRACT

A transparent electrorheological fluid having a fluid component, a particle component, and an activator wherein the index of refraction mismatch between the fluid component and the particle component is less than about 0.02 and wherein the conductivity of the particle component is at least about three times greater than the conductivity of the fluid component and is in the range of from about $1\times10^{-5}$ s/m to about $1\times10^{-9}$ s/m.

20 Claims, No Drawings

OPTICALLY TRANSPARENT ELECTRORHEOLOGICAL FLUIDS

FIELD OF THE INVENTION

The present invention relates to certain materials which exhibit substantial increases in flow resistance when exposed to electric fields. More specifically, the present invention relates to optically transparent electrorheological fluids which may be utilized in devices wherein it is beneficial to observe the mechanisms of the device contained within the fluid.

BACKGROUND OF THE INVENTION

Fluid compositions which undergo a change in apparent viscosity in the presence of an electrical field are commonly referred to as electrorheological fluids. Electrorheological fluids normally are comprised of particles dispersed within a carrier fluid and in the presence of an electrical field, the particles become polarized and are thereby organized into chains of particles within the fluid. The chains of particles act to increase the apparent viscosity or flow resistance of the overall fluid and in the absence of an electric field, the particles return to their unorganized or free state and the apparent viscosity or flow resistance of the overall fluid is correspondingly reduced.

An electrorheological fluid composed of a non-conductive solid dispersed within an oleaginous fluid vehicle is described in U.S. Pat. No. 3,047,507. The compositions contain a minimum amount of water and a minimum amount of a surface active dispersing agent and the non-conductive solid consists of finely divided particles having an average diameter of from about 0.1 to about 5 microns.

U.S. Pat. No. 4,702,855 discloses electrorheological fluids consisting of an aluminum silicate solid dispersed within a fluid medium wherein the aluminum/silicate atomic ratio on the surface of the aluminum silicate is in the range of 0.15 to 0.80. The aluminum silicates may be either amorphous or crystalline and may contain contaminants such as $Fe_2O_3$, $TiO_2$, CaO, MgO, $Na_2O$, and $K_2O$. The electrorheological fluids may optionally contain an effective quantity of an appropriate dispersing agent.

Electrorheological fluids containing a suitable quantity of finely divided, particulate conductive materials for use within an alternating-field chucking device are disclosed in U.S. Pat. No. 3,385,793. The conductive material may be a metal such as copper, iron, aluminum or zinc. The conductive material is incorporated into an electrorheological fluid consisting of a particulate solid dispersed in an oleaginous vehicle which may optionally contain surface active agents or activators.

U.S. Pat. No. 4,645,614 discloses an electrorheological fluid consisting of aqueous silica gel dispersed within silicone oil and containing an amino functional or silicon functional polysiloxane having a molecular weight above 800 as a dispersant. The dispersant is present in a concentration of from 1 to 30 percent by weight based on the silica gel particles.

As further background, it should be noted that in order for particles suspended in a fluid medium to appear transparent, the index of refraction of the fluid $n_1$ must match the index of refraction of the particle $n_2$ (i.e., $n_1 \approx n_2$) so that little or no light scattering takes place at the fluid-particle interfaces. Since the index of refraction n of a material is related to the permittivity $\epsilon$ or dielectric constant K of the material by Maxwell's relation:

$$n = \sqrt{\epsilon/\epsilon_o} = \sqrt{K}$$

where $\epsilon_o$ is the permittivity of free space, the particles and fluid in a transparent suspension are expected to have matching or identical permittivities.

However, in order for a material to polarize and respond as an electrorheological fluid, the particle and the fluid must have different permittivities. The polarizability $\beta$ of a particle in a fluid medium is given by:

$$\beta = \left(\frac{\epsilon_2 - \epsilon_1}{\epsilon_2 + 2\epsilon_1}\right)$$

where $\epsilon_1$ is the permittivity of the fluid and $\epsilon_2$ is the permittivity of the particle. If $\epsilon_2 = \epsilon_1$, then $\beta = 0$, no polarization occurs, and no electrorheological effect is observed. A highly transparent suspension would be expected to have $\epsilon_2 = \epsilon_1$ and would thus not be expected to work as an electrorheological fluid.

In certain applications, it is desirable to utilize an electrorheological fluid which is optically transparent so that the inner working and electrode structures of a device may be observed during operation. For example, in devices that rely on light transmission, it is necessary for light to pass through the electrorheological fluid in order to be properly detected by sensory equipment. A transparent electrorheological fluid could also be utilized in conjunction with colored particles to map out flow patterns or detect regions of electrical breakdown within the electrorheological fluid. An electrorheological fluid is therefore needed which exhibits sufficient optical transparency such that the inner working and electrode structures of an electrorheological device may be observed by the human eye.

SUMMARY OF THE INVENTION

The present invention is such an electrorheological fluid which enables a user of an electrorheological device to observe the inner working and electrode structures of an appropriate device. It has been discovered that electroactivity can be conferred upon a fluid which is comprised of a suspended particle and a carrier fluid whose respective indices of refraction are similar and which would therefore normally be expected to have little or no electroactivity. More specifically, it has been determined that by properly manipulating the conductivity of the suspended particle, electroactivity can be conferred upon the fluid/particle suspension without adversely affecting the transparency of the overall fluid.

The invention is an electrorheological fluid comprised of a carrier fluid and a suspended particle wherein the suspended particle has a conductivity within a critical range and wherein the indices of refraction of the carrier fluid and the particle differ by less than a critical amount. The absolute value of the difference between the index of refraction of the suspended particle and the index of refraction of the carrier fluid must be less than about 0.02 and the conductivity of the particle must be in the range from about $1 \times 10^{-5}$ siemens/meter (s/m) to about $1 \times 10^{-9}$ s/m in order for the electrorheological fluid to be sufficiently transparent such that the inner working of an electrorheological device can be observed by the human eye. Furthermore, the conductivity of the particle must be at least three times larger than the conductivity of the carrier fluid in order for the fluid to exhibit a significant electrorheological effect.

It is therefore an object of the present invention to provide an electrorheological fluid which can be utilized in applications requiring a high degree of optical transparency of the electrorheological fluid.

It is another object of the present invention to provide an electrorheological fluid which is both electroactive and optically transparent.

It is yet another object of the present invention to provide an electrorheological fluid of sufficient optical transparency which will allow a user of an appropriate electrorheological device to visually observe the internal mechanisms of the device.

DETAILED DESCRIPTION OF THE INVENTION

The present invention relates to a transparent electrorheological fluid comprised of a fluid component and a particle component. In accordance with the present invention, it is essential that the absolute value of the difference between the index of refraction of the fluid component and the index of refraction of the particle component be no more than a certain critical amount and that the particle exhibit a conductivity within a certain critical range.

The absolute value of the difference between the index of refraction of the fluid component and the index of refraction of the particle component is herein referred to as the index of refraction mismatch. The index of refraction mismatch in the transparent electrorheological fluids of the present invention must be no more than about 0.02, and preferably no more than about 0.01. The index of refraction mismatch for a particular electrorheological fluid formulation can be determined by utilizing a refractometer, a laser light scattering device or a set of calibrated fluids having predetermined indices of refraction.

The fluid component of the present invention can be essentially any oleaginous vehicle exhibiting the proper index of refraction mismatch with the particular corresponding particle. Typical carrier fluids useful in the present formulations include mineral oils, white oils, paraffin oils, chlorinated hydrocarbons such as 1-chlorotetradecane, silicone oils, transformer oils, halogenated aromatic liquids, halogenated paraffins, polyoxyalkylenes and fluorinated hydrocarbons, with mineral oils and 1-chlorotetradecane being the preferred carrier fluids. The fluid component must be selected to ensure that the conductivity of the particle component is from about 3 to about 1000 times, preferably about 30 to about 100 times greater than the conductivity of the fluid component. The conductivity of a given fluid can be determined by techniques well known in the art.

The suspended particles utilized in the electrorheological fluid formulations of the invention must exhibit a conductivity in the range from about $1\times10^{-5}$ s/m to about $1\times10^{-9}$ s/m. Conductivity can be determined from AC impedance measurements (complex dielectric spectra) made on a suspension of the particle in a known oil, preferably the same oil to be used in the electrorheological fluid. The Maxwell-Wagner theory of heterogeneous dielectrics can be utilized to determine conductivities from the AC impedance measurements.

The particle component can essentially be any solid which has the appropriate conductivity and index of refraction mismatch with the carrier fluid. Typical particle components useful in the present invention include amorphous silicas, synthetic silicas, precipitated silicas, fumed silicas, silicates, aluminum silicates, and other organic and polymeric particles known in the art such as those composed of polymethacrylic acid salts. Preferred particle components of the present invention include amorphous silicas, synthetic silicas and precipitated silicas. The particle component typically comprises from about 30 to about 50 percent by volume of the total composition depending on the desired electroactivity and viscosity of the overall fluid. The diameters of the particles utilized herein can range from about 0.1 to about 100 μm and preferably range from about 1.0 to about 10 μm.

An activator is required by the present invention in order to provide the necessary conductivities to the suspended particles. It is theorized that the adsorption of the activator onto the surface of the particle creates the conductivity required for electrorheological activity. Water is the most common activator and is preferred for use in the present invention although other activators such as various alcohol and amine compounds may also be utilized in lieu of, or in combination with, water. Suitable alcohol compounds include mono- or polyhydroxy hydrocarbons such as methanol, ethanol, propanol, isopropanol and ethylene glycol. Suitable amine compounds include primary and secondary aliphatic amines, polyamines such as triethylene tetraamine and ethanolamines such as triethanolamine. The amount of activator utilized in the present invention depends on the type of particle and the desired conductivity. Typically, the total amount of activator or combination of activators is from about 0.1 to about 10 percent by weight of the particle component, preferably from about 1 to about 5 percent by weight of the particle component.

A surfactant may also be utilized in the invention in order to ensure adequate dispersion and suspension of the particles in the carrier fluid. Typical useful surfactants known in the art include fatty acid esters, functionalized polydimethylsiloxanes, fatty amines, glycerol and glycol esters, ethoxylated fatty alcohols and acids, epoxide polymers and copolymers, block and graft copolymers, naphthenic and resinic acids, and combinations thereof. Preferred surfactants include functionalized polydimethylsiloxanes such as amino-functionalized polydimethylsiloxanes and glycerol esters such as glycerol monooleate. Generally, an amount of surfactant sufficient to create a monolayer of surfactant on the surface of the particle is required by the invention. The amount of surfactant required will also depend on the degree of dispersion and suspension and the type of flow properties desired in a certain application. Normally, the surfactant or combination of surfactants is present in an amount from about 1 to about 20 percent by weight of the particle component. Since most surfactants are soluble in the fluid component, it has been found that the presence of a surfactant does not substantially interfere with the transparency of the present fluids.

The transparent electrorheological fluids of the invention are prepared by mixing together the fluid component, the particle component, the activator and any desired surfactant. Examples of preferred transparent electrorheological fluid compositions are set forth below.

| Component | Example #1 Amount | n | Conductivity |
|---|---|---|---|
| Mineral Oil | 100.0 g | 1.467 | $<1.5 \times 10^{-10}$ s/m |
| Precipitated Silica | 15.0 g | 1.460 | $8.8 \times 10^{-8}$ s/m |
| Water | 0.45 g | | |
| Glycerol Monooleate | 3.0 g | | |

| Component | Example #2 Amount | n | Conductivity |
|---|---|---|---|
| 1-Chlorotetradecane | 100.0 g | 1.446 | $1.8 \times 10^{-9}$ s/m |
| Precipitated Silica | 40.0 g | 1.460 | $3.7 \times 10^{-6}$ s/m |
| Water | 2.4 g | | |
| Glycerol Monooleate | 9.7 g | | |

It has been discovered that particles having the conductivity and index of refraction requirements described herein have the surprising ability to exhibit an electroactive effect while maintaining a high degree of optical transparency. The present electrorheological fluids allow a user of an appropriate electrorheological device to observe the inner working and electrode structures of the device during operation. The transparent fluids are particularly useful in applications which require light transmission through a device and the fluids may be effectively utilized to observe flow patterns and/or electrical breakdown within an electrorheological device.

It is understood that the foregoing is a description of the preferred embodiments of the present invention and that the scope of the invention is not limited to the specific terms and conditions set forth above but is determined by the following claims.

What is claimed is:

1. A transparent electrorheological fluid consisting essentially of a carrier fluid, a particle component, and an activator wherein the index of refraction mismatch is less than about 0.02 and wherein the conductivity of the particle component is at least about three times greater than the conductivity of the carrier fluid and is in the range of from about $1\times10^{-5}$ s/m to about $1\times10^{-9}$ s/m.

2. An electrorheological fluid according to claim 1 wherein the carrier fluid is selected from the group consisting of mineral oils, white oils, paraffin oils, chlorinated hydrocarbons, silicone oils, transformer oils, halogenated aromatic liquids, halogenated paraffins, polyoxyalkylenes and fluorinated hydrocarbons.

3. An electrorheological fluid according to claim 1 wherein the carrier fluid is mineral oil having an index of refraction of about 1.467.

4. An electrorheological fluid according to claim 1 wherein the carrier fluid is 1-chlorotetradecane having an index of refraction of about 1.446.

5. An electrorheological fluid according to claim 1 wherein the particle component is selected from the group consisting of amorphous silicas, synthetic silicas, precipitated silicas, fumed silicas, silicates, aluminum silicates and polymethacrylic acid salts.

6. An electrorheological fluid according to claim 1 wherein the particle component is precipitated silica having an index of refraction of about 1.460 and a conductivity from about $1\times10^{-7}$ s/m to about $1\times10^{-9}$ s/m.

7. An electrorheological fluid according to claim 1 wherein the activator is selected from the group consisting of water, an alcohol compound and an amine compound.

8. An electrorheological fluid according to claim 1 wherein the activator is water.

9. An electrorheological fluid according to claim 1 further comprising a surfactant.

10. An electrorheological fluid according to claim 9 wherein the surfactant is a functionalized polydimethylsiloxane or a glycerol ester.

11. An electrorheological fluid according to claim 9 wherein the surfactant is glycerol monooleate.

12. An electrorheological fluid according to claim 1 wherein the index of refraction mismatch is less than about 0.01.

13. An electrorheological fluid according to claim 1 wherein the conductivity of the particle component is from about 30 to about 100 times greater than the conductivity of the carrier fluid.

14. A transparent electrorheological fluid consisting essentially of a carrier fluid, a particle component, an activator and a surfactant wherein the index of refraction mismatch is less than about 0.01 and wherein the conductivity of the particle component is at least about 30 times greater than the conductivity of the carrier fluid and is in the range of from about $1\times10^{-5}$ s/m to about $1\times10^{-9}$ s/m.

15. An electrorheological fluid according to claim 14 wherein the carrier fluid is mineral oil having an index of refraction of about 1.467.

16. An electrorheological fluid according to claim 14 wherein the fluid component is 1-chlorotetradecane having an index of refraction of about 1.446.

17. An electrorheological fluid according to claim 14 wherein the surfactant is glycerol monooleate.

18. An electrorheological fluid according to claim 14 wherein the activator is water.

19. A transparent electrorheological fluid consisting essentially of mineral oil having an index of refraction of about 1.467 and a conductivity of less than about $1.5\times10^{-10}$ s/m, precipitated silica having an index of refraction of about 1.460 and a conductivity of about $8.8\times10^{-8}$ s/m, water and glycerol monooleate.

20. An electrorheological fluid according to claim 19 wherein the precipitated silica is present in an amount from about 30 to about 50 percent by volume of the total fluid, the water is present in an amount from about 1 to about 5 percent by weight of the precipitated silica and the glycerol monooleate is present in an amount from about 1 to about 20 percent by weight of the precipitated silica.

* * * * *